US010816008B1

(12) United States Patent
Keener

(10) Patent No.: US 10,816,008 B1
(45) Date of Patent: Oct. 27, 2020

(54) DUAL STAGE GRINDER PUMP

(71) Applicant: Gregg Keener, Ashland, OH (US)

(72) Inventor: Robert Keener, Ashland, OH (US)

(73) Assignee: Gregg Keener, Ashland, OH (US)

( * ) Notice: Subject to any disclaimer, the term of this patent is extended or adjusted under 35 U.S.C. 154(b) by 90 days.

(21) Appl. No.: 16/380,593

(22) Filed: Apr. 10, 2019

Related U.S. Application Data

(60) Provisional application No. 62/660,341, filed on Apr. 20, 2018.

(51) Int. Cl.

| | |
|---|---|
| ***F04D 29/22*** | (2006.01) |
| *F04B 23/06* | (2006.01) |
| *F04D 1/10* | (2006.01) |
| *F04D 7/04* | (2006.01) |
| *F04D 1/06* | (2006.01) |
| *F04D 7/02* | (2006.01) |

(52) U.S. Cl.
CPC ..... *F04D 29/2211* (2013.01); *F04B 23/06* (2013.01); *F04D 1/06* (2013.01); *F04D 1/10* (2013.01); *F04D 7/02* (2013.01); *F04D 7/04* (2013.01); *F04D 7/045* (2013.01); *F04D 29/2216* (2013.01)

(58) Field of Classification Search
CPC ..... F04D 29/2211; F04D 1/06; F04D 1/10; F04D 7/02; F04D 7/04; F04D 7/045
See application file for complete search history.

(56) References Cited

U.S. PATENT DOCUMENTS

| | | | | |
|---|---|---|---|---|
| 3,131,877 | A * | 5/1964 | Budzien | F04D 13/02 241/251 |
| 4,099,890 | A * | 7/1978 | Murakami | F04D 7/04 277/350 |
| 4,378,093 | A * | 3/1983 | Keener | F04D 7/045 241/46.017 |
| 5,567,133 | A * | 10/1996 | Kobaybashi | F04D 13/14 417/423.7 |
| 6,916,152 | B2 * | 7/2005 | Keener | F04D 1/06 241/46.11 |
| 7,354,009 | B2 * | 4/2008 | Keener | F04D 7/045 241/185.6 |
| 9,377,027 | B2 * | 6/2016 | Behnke | F04D 1/006 |
| 9,719,515 | B2 * | 8/2017 | Pohler | F04D 7/045 |
| 9,897,090 | B2 * | 2/2018 | Burgess | F04D 29/4273 |
| 2008/0159876 | A1 * | 7/2008 | Keener | H02K 17/30 417/44.11 |

* cited by examiner

*Primary Examiner* — Kenneth J Hansen
*Assistant Examiner* — Behnoush Haghighian
(74) *Attorney, Agent, or Firm* — Ralph E. Jocke; Walker & Jocke

(57) ABSTRACT

A dual stage grinder pump (10) includes a housing (12) with a liquid inlet (20) and an outlet (26). An impeller (36) includes first impeller vanes (52) on a first axial side, and second impeller vanes (60) on a second axial side. A grinder (40) operates to reduce the size of suspended solids in the liquid that enters the pump inlet. Liquid passes from the inlet to a first fluid passage (30) and is acted upon by first vanes of the impeller in a first stage, and then passes through a second fluid passage (72). Liquid is acted upon by the second vanes of the impeller in a second stage and is passed through a third fluid passage (88) to the outlet.

21 Claims, 12 Drawing Sheets

DUAL STAGE GRINDER PUMP

TECHNICAL FIELD

Exemplary embodiments relate to pumps suitable for pumping liquid material. Exemplary embodiments specifically relate to a grinder pump that is suitable for pumping liquids with suspended solids therein.

BACKGROUND

The transport of liquid material is important in many different types of processes. The transport of liquid relies on pumps to move the liquid between locations. Depending on the nature of liquid being pumped, it may be desirable to have the pump develop high pressure, high flow or optimum combinations of both.

Pumping liquids becomes more challenging when the liquids contain suspended solids therein. Depending on the nature of the solids, such suspended material may cause clogging, abrasion or undesirable conditions which adversely impact pump operation. Adverse conditions may also shorten the useful life of a pump. Pump failure often results in costly system downtime, as well as the cost to repair or replace the failed pump.

Liquid pumps may benefit from improvements.

SUMMARY

Exemplary embodiments relate to a grinder pump that is useful for pumping liquid that includes suspended solids therein. The exemplary pump includes a housing with a liquid inlet and a liquid outlet. A grinder is positioned adjacent to the inlet to the pump. The grinder operates to reduce the size of suspended solids in the liquid near the time when the liquid enters the interior of the pump.

The housing includes a cylindrical impeller cavity. The exemplary pump further includes a single impeller that includes impeller vanes on each axial side of the impeller. Fluid passages in the housing direct liquid to and from the impeller cavity, and cause liquid to be passed through the impeller cavity along two sequential flow paths in which pumping force is imparted to the liquid by the impeller vanes on each axial side of the impeller. This exemplary arrangement provides increased flow and pressure from a compact pump arrangement.

Numerous additional features and benefits are provided by the exemplary embodiments of the dual stage grinder pump as discussed herein.

DETAILED DESCRIPTION

Figure 1:
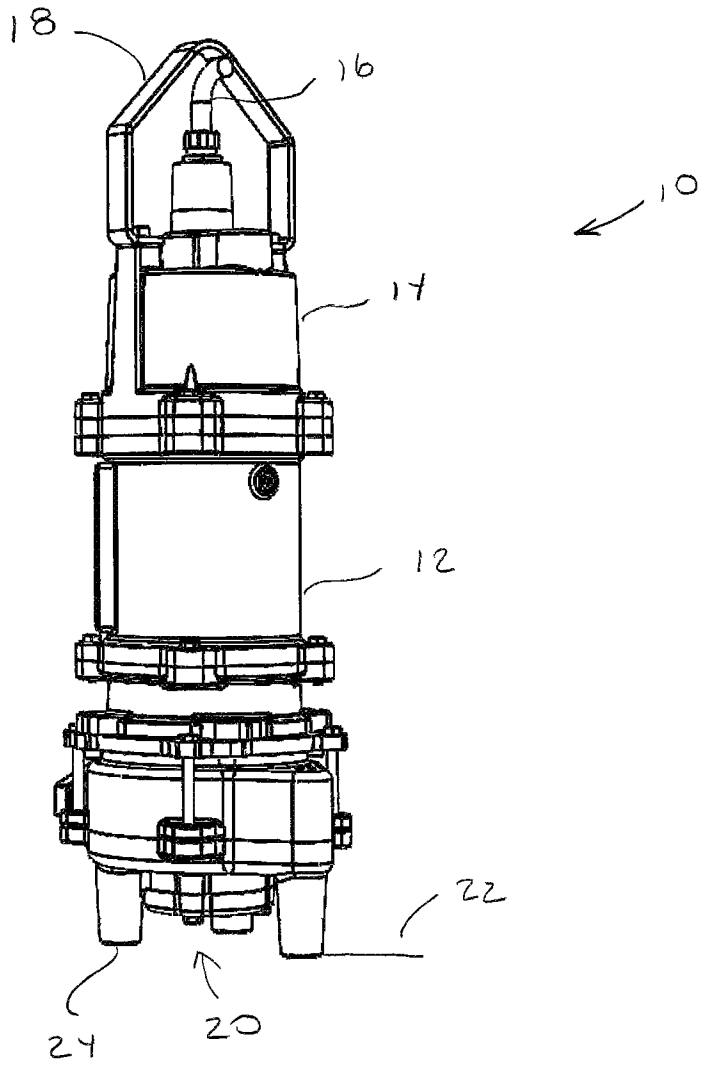
FIG. 1 is a right side view of a dual stage grinder pump of an exemplary embodiment.
Figure 2:
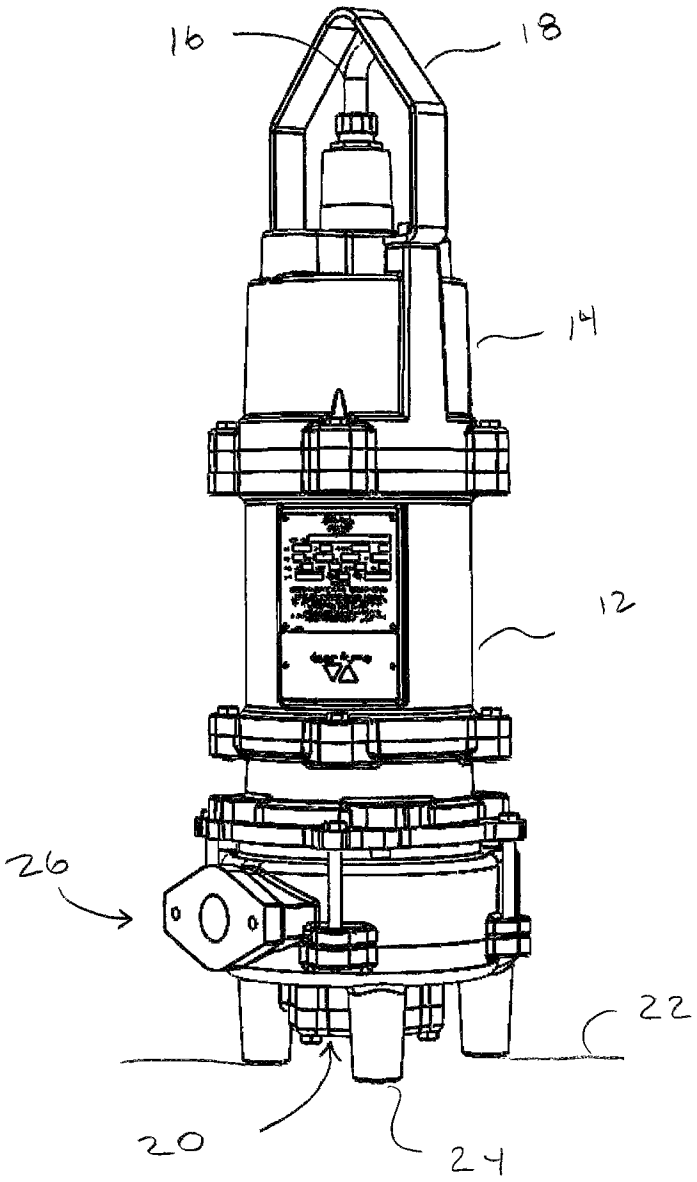
FIG. 2 is a left side view of the dual stage grinder pump.

Referring now to the drawings and particularly to FIG. 1 there is shown therein an exemplary embodiment of a dual stage grinder pump generally indicated 10. The pump 10 includes a housing 12. The exemplary housing 12 is made up of numerous different housing components which are held together by fasteners as hereafter discussed.

The exemplary housing includes a motor 14. In the exemplary arrangement the motor includes an electric motor that receives power through an electric line 16 a portion of which is shown. As can be appreciated the electric line is connected to a source of electrical power for purposes of operating the pump. The exemplary pump housing 12 further includes an upper handle 18. The upper handle 18 is configured to enable engaging the pump for purposes of installation and removal.

The exemplary pump housing includes a liquid inlet 20. The liquid inlet is disposed away from a bottom surface 22 of a sump or other liquid holding container in which the pump is positioned, by a plurality of downward extending feet 24. The pump housing 12 further includes a liquid outlet 26. The outlet 26 is configured for connection to a suitable pipe, hose or other fluid conduit which is used to carry the liquid away from the pump 10. Of course it should be understood that this pump configuration is exemplary, and the principles described herein may be used in connection with other types of pump configurations.

Figure 3:
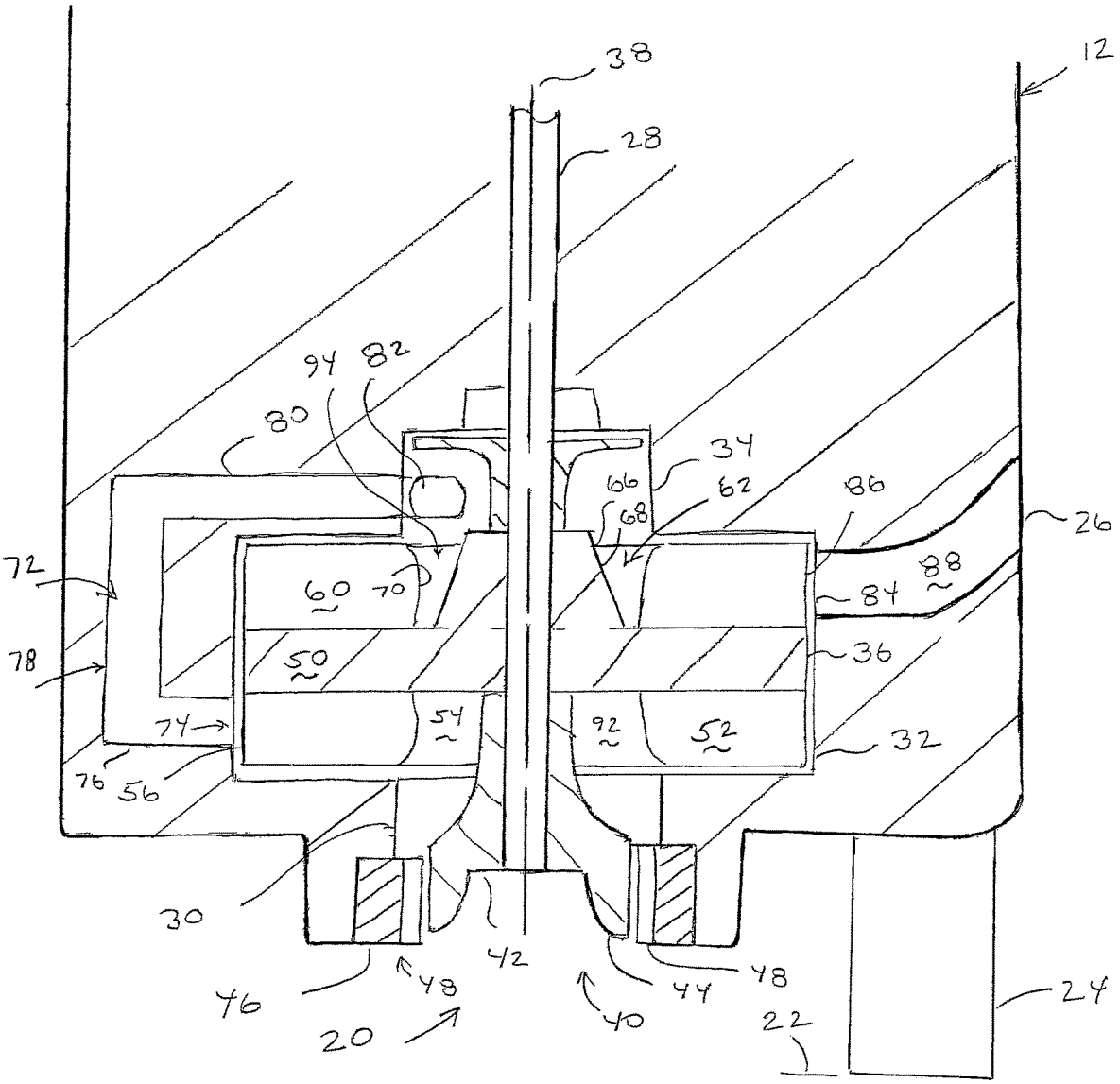
FIG. 3 is a schematic cross-sectional view that demonstrates the operation of the exemplary pump.
Figure 4:
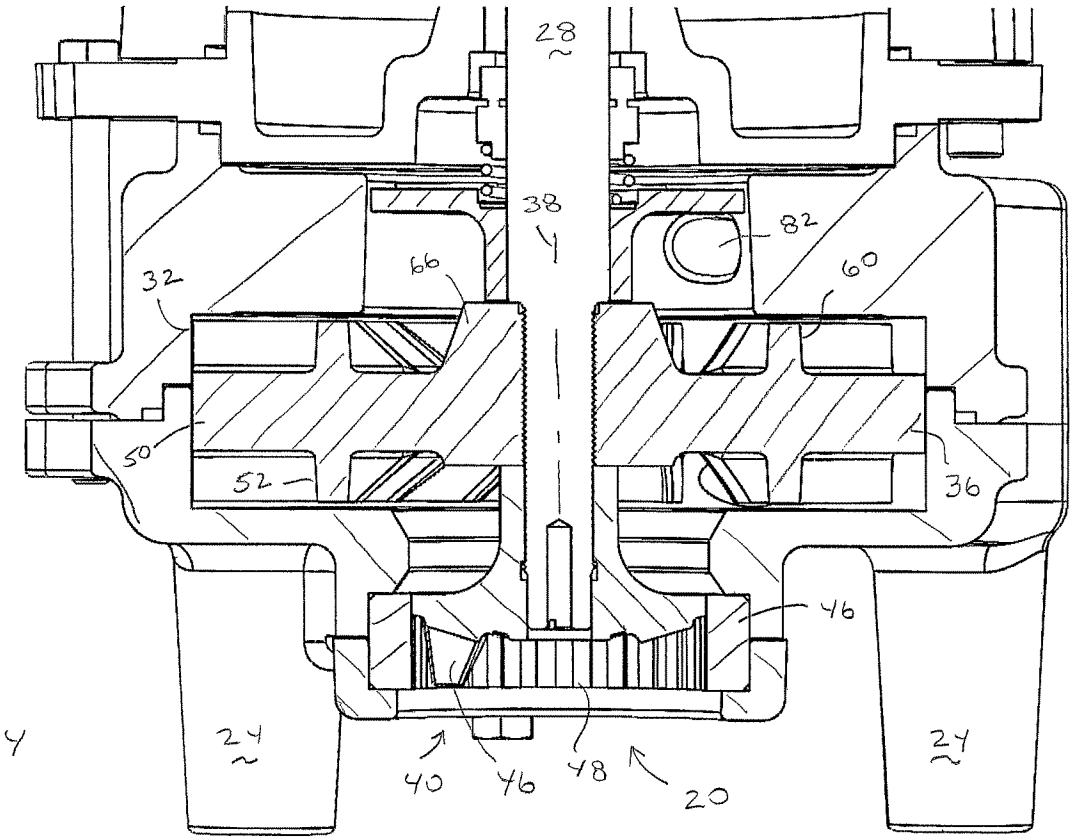
FIG. 4 is a cross-sectional view of the lower end of the pump housing components and impeller.

FIG. 3 is a cross-sectional schematic view that demonstrates the operation of the exemplary dual stage grinder pump. It should be understood that the components of the exemplary pump are shown schematically in FIG. 3 to facilitate understanding the principles by which the pump operates. In the exemplary pump the motor 14 is operative to rotate a shaft 28. In the operational condition of the pump the shaft extends in a vertical direction. The shaft is held in a guided position within the housing 12 through the use of bearings, bushings and other suitable components.

The exemplary housing 12 bounds a first fluid passage 30. First fluid passage 30 extends from the inlet 22 to a cylindrical impeller cavity 32. A cylindrical chamber 34 extends above the impeller cavity in the operational position of the pump. In the exemplary arrangement the shaft 28 is in fixed rotational connection with an impeller 36. The impeller and shaft are configured to rotate together about an axis 38.

A grinder 40 is positioned in the first fluid passage 30 adjacent to the inlet 20 of the housing. The exemplary grinder includes a rotor 42. The rotor 42 includes a plurality of angularly spaced blades 44. The rotor 42 rotates in operative engagement with the shaft 28 as well as the impeller 36. The exemplary grinder 40 further includes a stator 46. The stator 46 is in fixed operative connection with the housing 12 and remains stationary while the rotor rotates. The exemplary stator includes a plurality of angularly spaced axially elongated openings 48 in the annular inner surface that bounds the inner circumference of the stator. The openings 48 are sized to enable liquid and suitably sized suspended solids in the liquid to pass therethrough into the impeller cavity 32. In the exemplary grinder the rotating blades 44 of the rotor move across the fluid openings 48 in the stator so as to reduce the size of suspended solid material in the liquid that can reach the impeller cavity. Of course it should be understood that this grinder configuration is exemplary and numerous other types of grinders that reduce the size of suspended solids in the liquid may be used.

Figure 6:
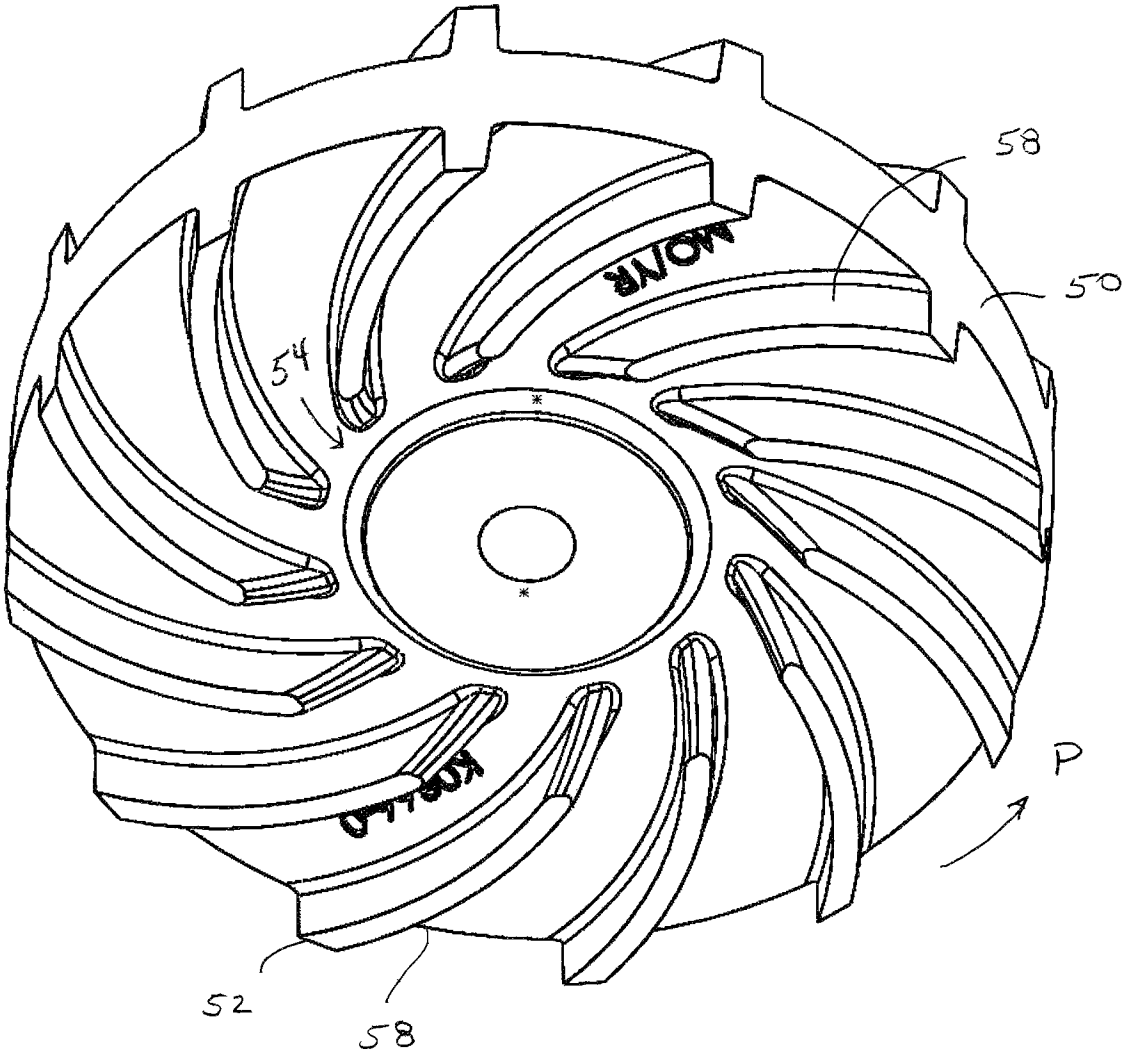
FIG. 6 is a bottom perspective view of the exemplary impeller.

In the exemplary arrangement the exemplary impeller 36 is comprised of a unitary body which includes a disc shaped base 50. The impeller further includes a plurality of angularly spaced first impeller vanes 52. First impeller vanes 52 extend outward from the base 50 in a first axial direction, which is downward as shown in FIG. 3. The first impeller vanes also extend radially outward from a central area 54 on a first side of the impeller to a radially outward periphery 56 of the first vanes. As shown in FIG. 6 in the exemplary arrangement first vanes 52 comprise curved helical vanes. The exemplary helical vanes each have a leading face 58 that extends generally perpendicular to the base. Each respective leading face 58 of a first vane 52 leads when the impeller is rotated by the motor in a pumping direction represented by Arrow P as shown in FIG. 6.

The exemplary impeller 36 further includes a plurality of second impeller vanes 60. Second vanes 60 extend axially outward from the base 50 in a second axial direction opposed of the first axial direction. Each of the second vanes 60 also extend radially outward from a central area 62 on the upper side of the impeller 36 as shown.

Figure 5:
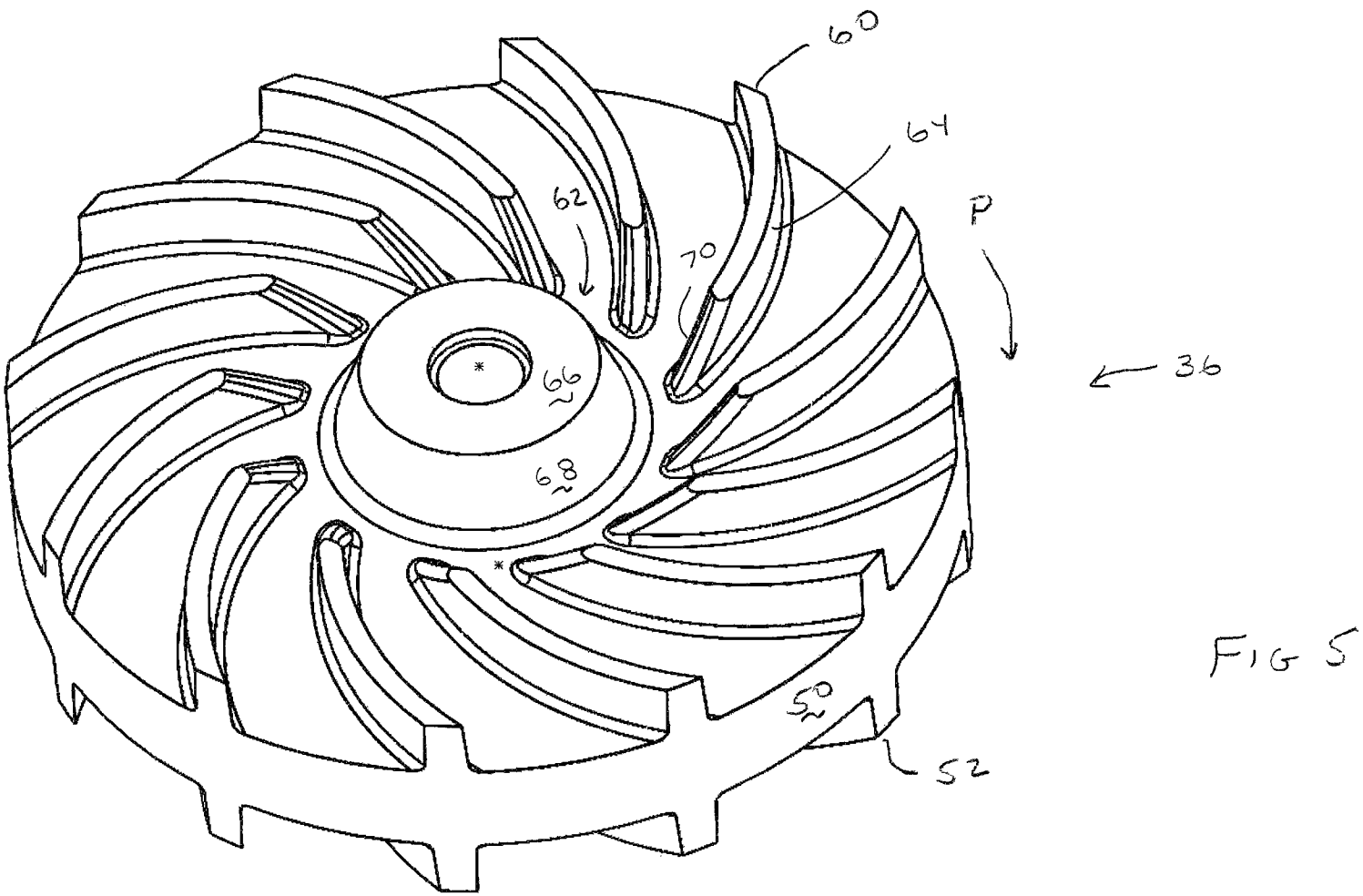
FIG. 5 is a top perspective view of the exemplary impeller.

As shown in FIG. 5, the exemplary second impeller vanes 60 comprise curved helical vanes. Each of the vanes 60 include a leading face 64 which extends generally perpendicular to the base. Each respective leading face 64 is leading when the impeller 36 rotates in the pumping direction.

In the exemplary embodiment the impeller 36 includes an axially centered projection 66. Axially centered projection 66 extends from the base 50 outward in the second axial direction which is upward as represented in FIG. 3. In the exemplary arrangement projection 66 is bounded radially outwardly by a tapered side wall 68. In the exemplary arrangement the tapered side wall 68 extends further radially outward with increasing proximity to the impeller base 50. In the exemplary arrangement the tapered side wall 68 is disposed radially inward of the second vanes 60 which each terminate radially inward at a respective inward face 70. Of course it should be understood that this arrangement is exemplary and in other embodiments other approaches may be used.

Figure 7:
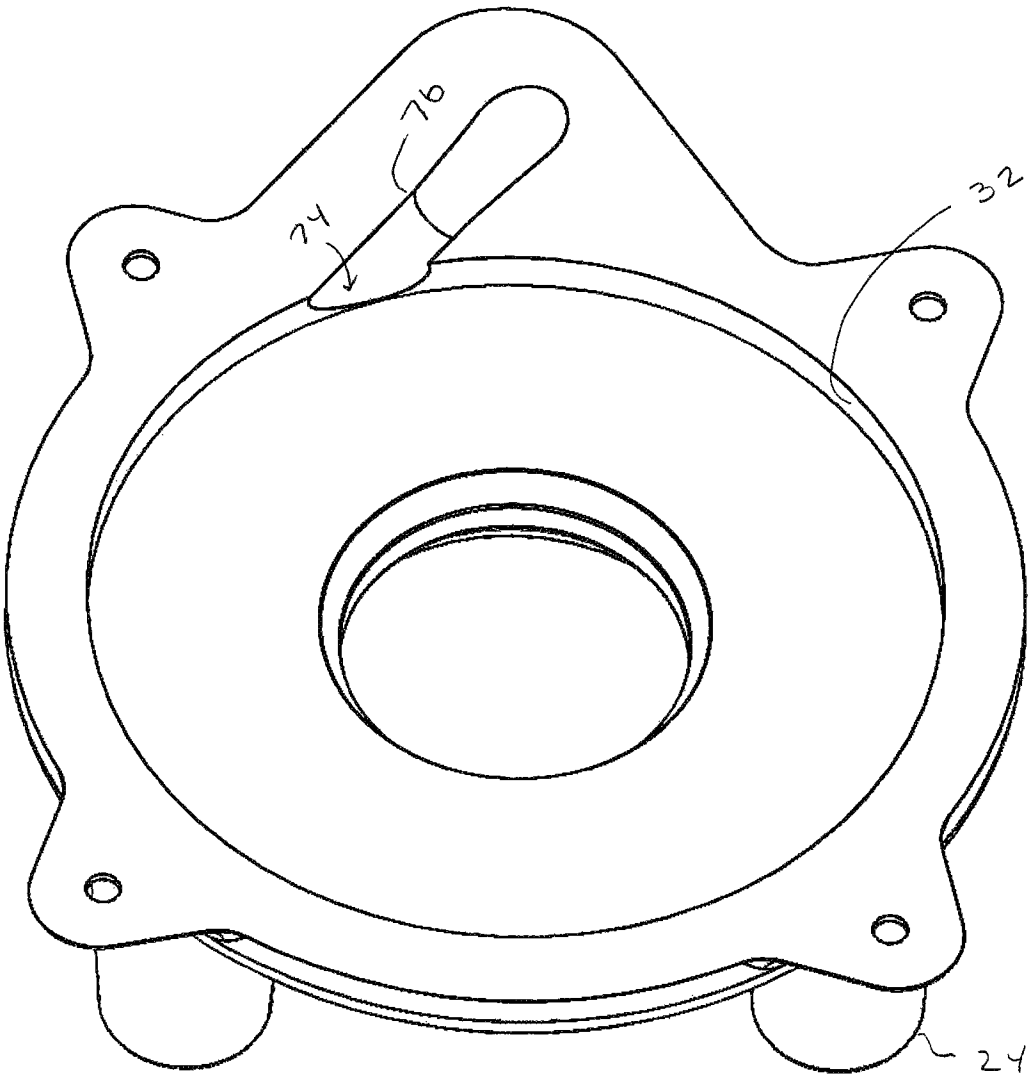
FIG. 7 is a top perspective view of a lower housing component and showing a portion of a fluid passage from the first stage to the second stage.
Figure 8:
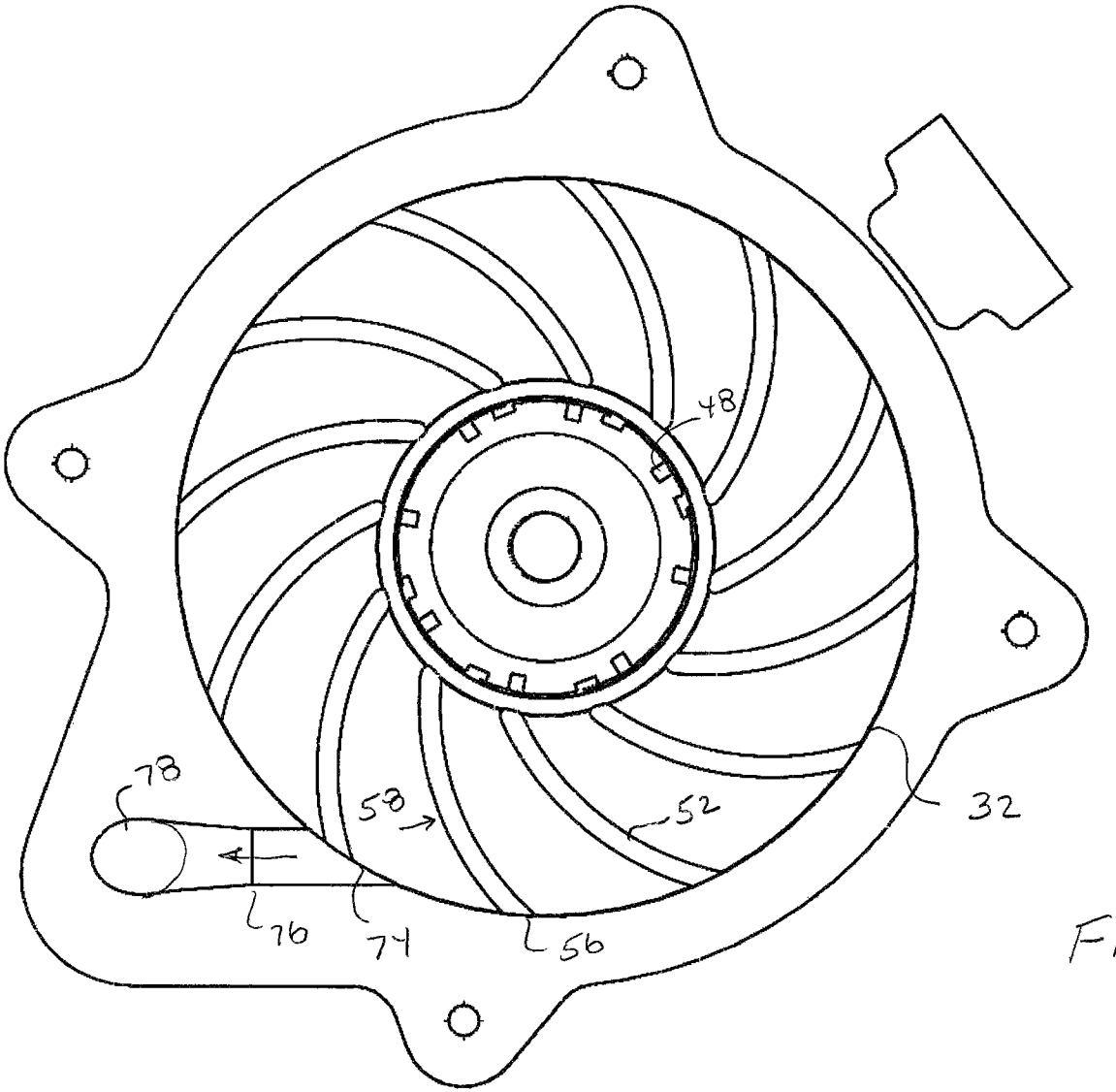
FIG. 8 is a transverse cross sectional top view through the lower housing component with the first impeller vanes shown therein.

In the exemplary dual stage grinder pump 10 shown schematically in FIG. 3, a second fluid passage 72 extends in the housing. Fluid passage 72 extends from a first peripheral area opening 74 which extends through the housing wall bounding the impeller cavity 32. The first peripheral area opening 74 from the cavity is adjacent to the radially outer periphery of the first vanes 52. In an exemplary arrangement the second fluid passage 72 includes an initial portion 76. As shown in FIGS. 7 and 8, in the exemplary arrangement the initial portion 76 of fluid passage 72 extends outward from the impeller cavity 32 in a direction that is generally perpendicular to the leading faces 58 of the first impeller vanes 52 at the radially outward periphery of such vanes. This configuration provides for the pump to take advantage of the directed centrifugal force imparted to the liquid by the helically curved impeller vanes. Of course this configuration is exemplary and other embodiments other arrangements may be used.

Figure 9:
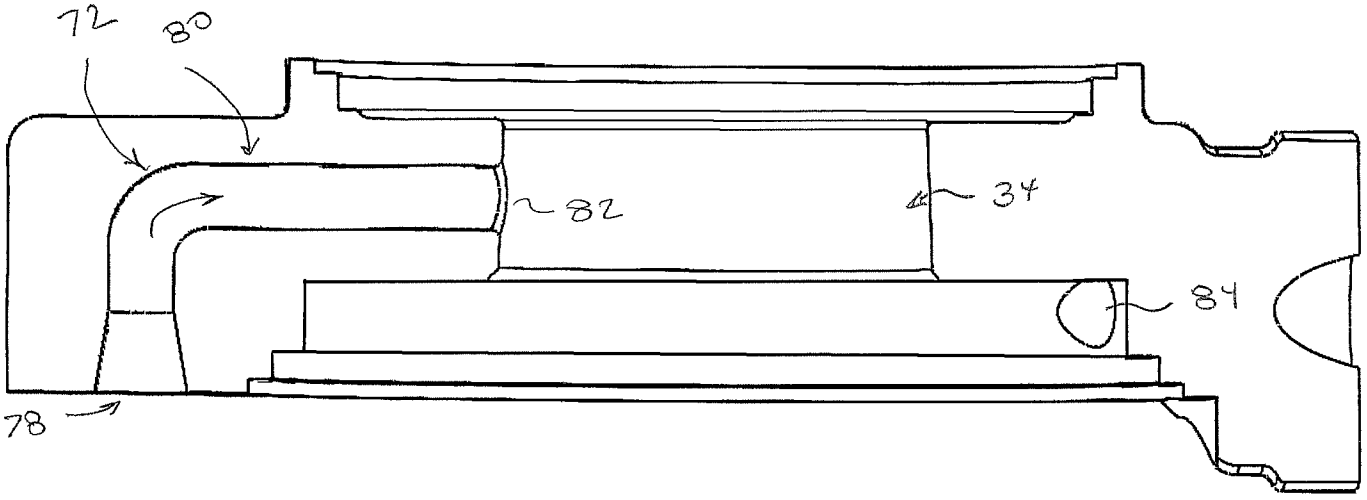
FIG. 9 is an axial cross-sectional view of an upper housing component.
Figure 10:
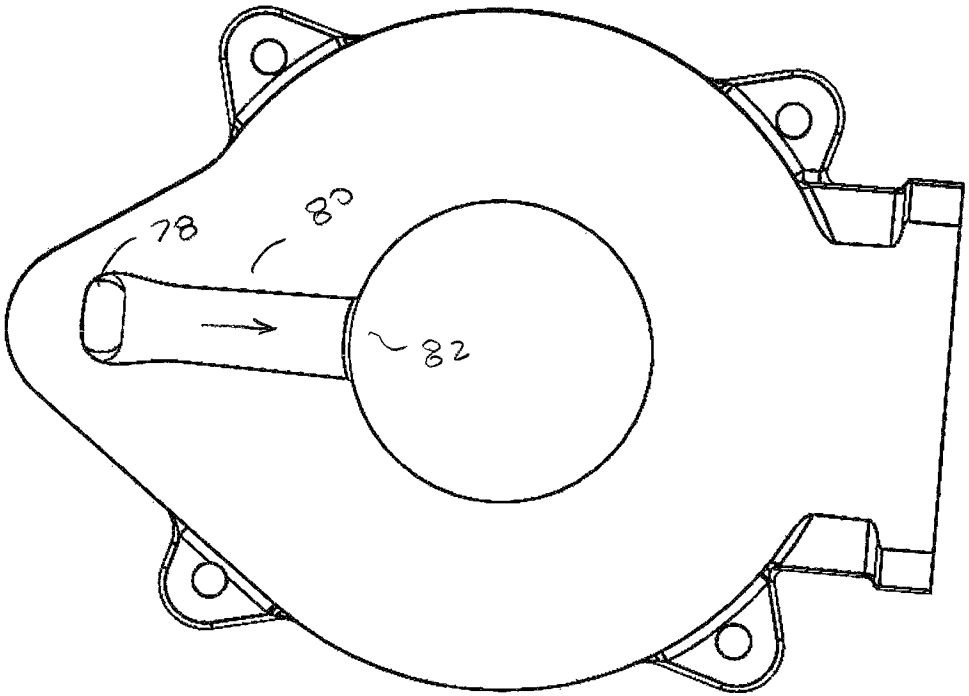
FIG. 10 is a transverse cross-sectional view of the upper housing component.
Figure 11:
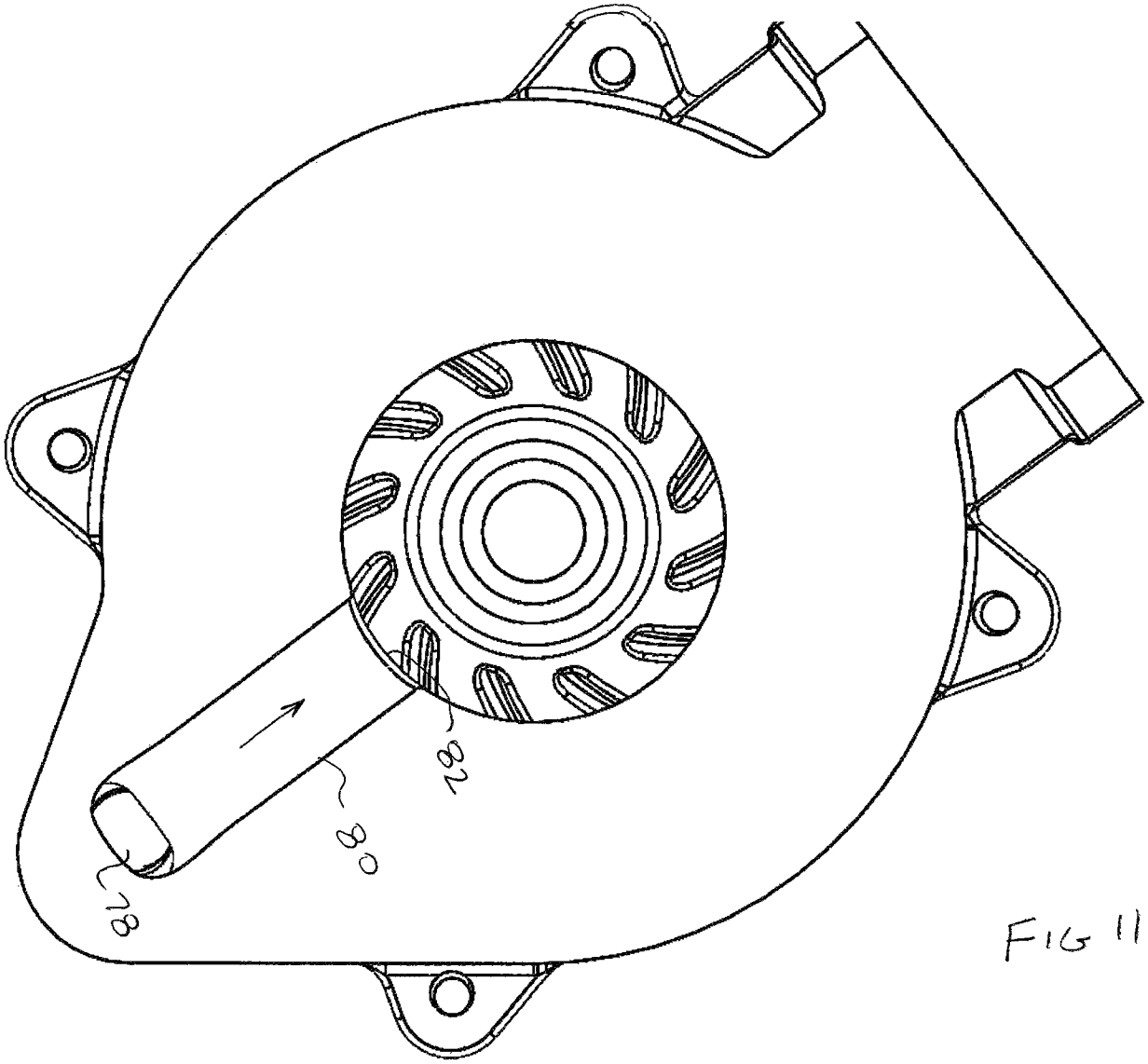
FIG. 11 is a further transverse cross-sectional view of an upper housing component showing an exemplary fluid passage to the second stage.

As represented in FIG. 3 the second fluid passage 72 includes an axially extending portion 78. The axially extending portion extends parallel to the axis 38. The axially extending portion 78 directs the fluid in the second fluid passage 72 to a radially inward termination portion 80. Termination portion 80 terminates in a passage opening 82 that extends through the housing wall bounding the cylindrical chamber 34. As shown in FIGS. 9, 10 and 11, in the exemplary arrangement the termination portion 80 of the second fluid passage 72 extends radially inward relative to the axis 38. The termination portion 80 has the passage opening 82 thereof positioned in vertically overlying relation of the centered projection 66 and tapered wall 68 of the impeller 36. This configuration provides for liquid that is pumped through the second fluid passage 72 to be deposited into the central area 62 of the second vanes 60 of the impeller 36.

In the exemplary arrangement the impeller cavity 32 further includes a second peripheral area opening 84. The second peripheral area opening 84 is positioned adjacent to a radially outward periphery 86 of the second vanes 60. The second peripheral area opening is connected to a third fluid passage 88. The third fluid passage 88 is operative to fluidly connect the second peripheral area opening 84 and the fluid outlet 26 of the housing.

Figure 12:
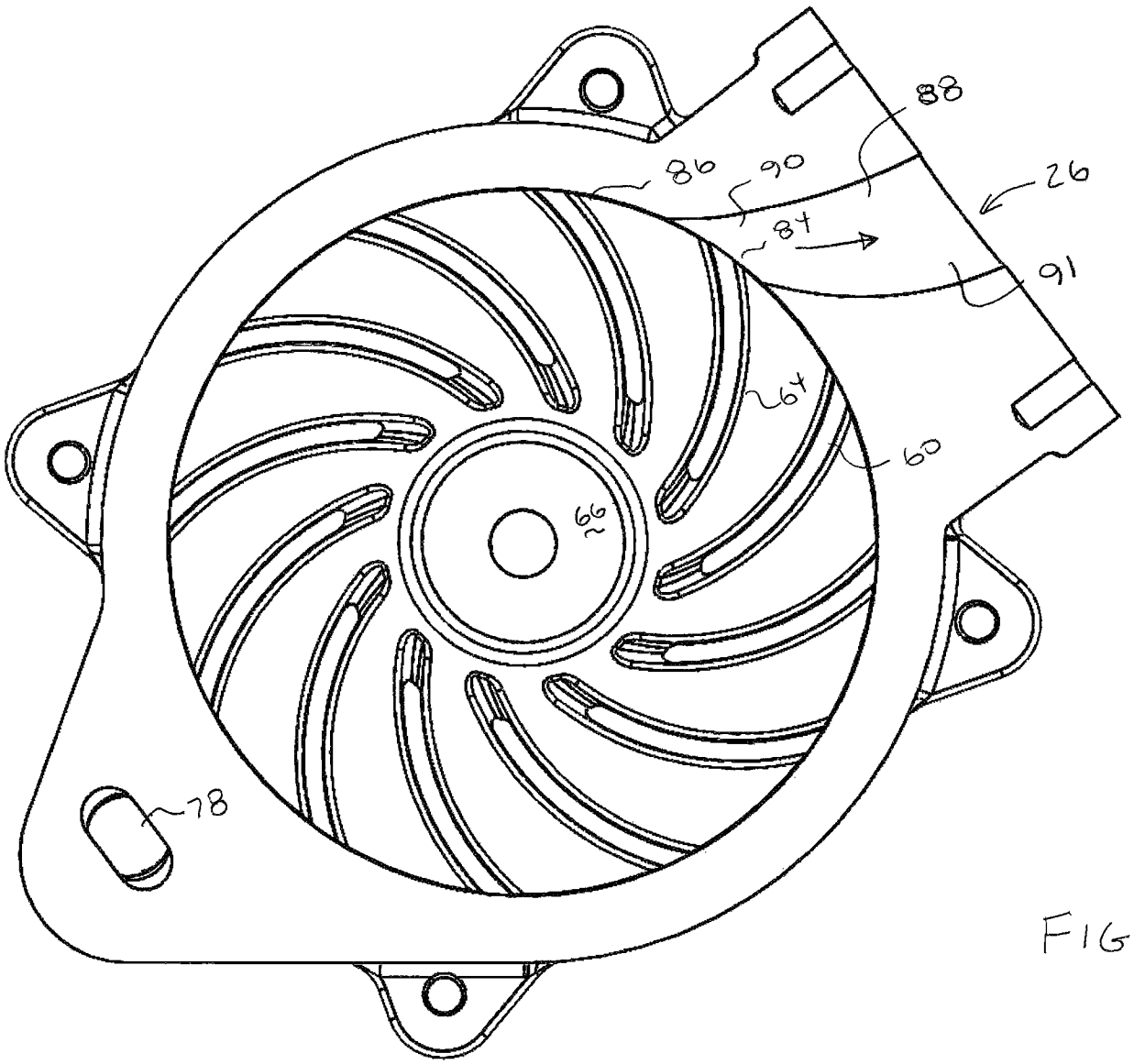
FIG. 12 is a further transverse cross-sectional view of an upper housing component showing a further fluid outlet passage from the second stage.

As shown in FIG. 12 in an exemplary arrangement the third fluid passage 88 includes an initial portion 90. The initial portion 90 is configured to extend away from the second peripheral area opening 84 in a direction that is generally perpendicular to the leading faces 64 of the second vanes 60 at the radially outer periphery 86 of the second vanes 60. The third fluid passage includes a radially outward extending portion 91 that extends to the outlet 26. This exemplary arrangement takes advantage of the directed centrifugal force imparted to the liquid by the second impeller vanes 60. Of course it should be understood that this arrangement is exemplary and other embodiments other approaches may be used.

As shown in FIGS. 5 and 6, the exemplary dual stage impeller 36 is configured with the first impeller vanes 52 and the second impeller vanes 60 positioned in pairs that extend in opposed axial directions from the base 50. The configuration of the first and second vanes is such that the vanes are continuously aligned on each side of the base 50 in all radial locations of each of the respective vanes of a given pair. This configuration provides that in cross-section the impeller has continuous material from the furthest axial side in the second axial direction of each second impeller vane, to the furthest axial side in the first axial direction of each respective first impeller blade of the pair. Further the continuous material is present at each radial position on the impeller at which the first and second impeller blades are present. This provides for a strong unitary impeller to facilitate the dual stage pumping action that is achieved by the exemplary pump configuration.

In pump operation liquid enters the inlet 20 of the housing through the openings 48 in the stator 46. Suspended solids in the liquid that are larger than the openings are broken up as the blades 44 of the rotor 42 of the grinder rotate in coordinated relation with the impeller across each of the openings. The liquid passes upward in the first fluid passage 30 into a first central area 92 of the impeller cavity 32. The first central area 92 is adjacent the axis 38 of the impeller and the central area 54 radially inward of the first impeller vanes 52.

Liquid in the first central area 92 is engaged by the first impeller vanes 52 and moves outward due to the centrifugal force imparted by the vanes, to the first peripheral area opening 74 of the second fluid passage 72, which opening 74 is disposed radially outward of the first central area 92. The liquid which has been moved in the first stage by the first impeller vanes 52 is conducted through the second fluid passage 72 to the passage opening 82. The passage opening 82 is disposed radially inward of opening 74 and in axially overlying relation of the centered projection 66 and tapered side wall 68.

From the passage opening 82 the liquid moves downward into a second central area 94 of the impeller cavity 32. The second central area 94 generally corresponds to the central area 62 that is radially inward of the second impeller vanes 60. From the second central area 94 the liquid is moved through the centrifugal force created by the second impeller vanes 62 to the second peripheral area opening 84 located at the outer periphery 86 of the second impeller vanes. From the second peripheral area opening 84 the liquid that has now passed through the second stage is passed through the third fluid passage 88 to the liquid outlet 26.

Thus in the exemplary arrangement the single impeller 36 is operative to impart pumping force to the liquid in a first stage in which the liquid is acted on in the impeller cavity by the first vanes 52. The liquid is then acted on in a second stage as the liquid passes through the impeller cavity a second time and is acted on by the second impeller vanes 60. This exemplary arrangement provides efficient pumping capabilities and relatively higher pressures and flow rates in a compact pump arrangement. The exemplary arrangement further provides a durable and reliable pump construction that helps to achieve a longer service life. In addition the arrangement of the exemplary housing which is constructed of numerous housing sections that may be disassembled, facilitates the repair and replacement of pump components. Of course it should be understood that the arrangements and components described herein are exemplary, and other pump arrangements and configurations may be constructed by persons having skill in the field using the principles and relationships that have been described herein.

Thus the exemplary embodiments described herein achieve improved operation, eliminate difficulties encountered in the use of prior devices and systems, and attain the useful results described herein.

In the foregoing description certain terms have been used for brevity, clarity and understanding. However no unnecessary limitations are to be implied therefrom because such terms are used for descriptive purposes and are intended to be broadly construed. Moreover the descriptions and illustrations herein are by way of examples and the invention is not limited to the exact features shown and described.

Further in the following claims any feature described as a means for performing a function shall be construed as encompassing any means known to those skilled in the art as being capable of carrying out the recited function, and such claims shall not be deemed limited to the particular means shown or described for performing the recited function in the foregoing description, or mere equivalents thereof.

Having described the features, discoveries and principles of the exemplary embodiments, the manner in which they are constructed and operated, and the advantages and useful results attained, the new and useful structures, devices, elements, arrangements, parts, combinations, systems, equipment, operations, components, methods, processes and relationships are set forth in the appended claims.

I claim:

1. Apparatus comprising:

a liquid pump including
- a housing, wherein the housing includes
  - an inlet,
  - an outlet,
  - a cylindrical impeller cavity bounded by the housing,
- an impeller, wherein the impeller
  - is rotatable about an axis within the impeller cavity,
- wherein the impeller includes
  - a disc shaped base,
  - a plurality of first impeller vanes, wherein each of the first vanes extend outward from the base in a first axial direction and radially outward relative to the axis,
  - a plurality of second impeller vanes, wherein each of the second impeller vanes extend outward from the base in a second axial direction opposed of the first axial direction, and radially outward relative to the axis,
  - wherein each of the first impeller vanes and the second impeller vanes are operative to direct liquid in the impeller cavity radially outward relative to the axis responsive to rotation of the impeller in a pumping direction,
- wherein the housing further includes
  - a first fluid passage,
    - wherein the first fluid passage fluidly extends from the inlet to a first central area of the impeller cavity, wherein the first central area is adjacent to the axis and the first impeller vanes,
  - a second fluid passage,
    - wherein the second fluid passage fluidly extends from a first peripheral area opening of the impeller cavity adjacent a radially outward periphery of the first impeller vanes and radially outward of the first central area, to a second central area of the impeller cavity, wherein the second central area is adjacent the axis and the second impeller vanes and radially disposed inwardly relative to the first area opening,
  - a third fluid passage,
    - wherein the third fluid passage extends from a second peripheral area opening of the impeller cavity adjacent a radially outward periphery of the second impeller vanes, to the outlet, wherein the second peripheral area opening is disposed radially outward of the second central area and is axially disposed from the first peripheral area opening,
- whereby with the impeller rotating in the pumping direction, liquid is enabled to enter the inlet and is moved through the first fluid passage to the first central area,
- is then moved radially outward in the impeller cavity by the first vanes to the second fluid passage,
- is then passed through the second fluid passage to the second central area, and
- is then moved by the second impeller vanes through the third fluid passage and to the outlet.

2. The apparatus according to claim 1 and further including a grinder in the first fluid passage, wherein the grinder is configured to reduce size of suspended solids in the liquid that enters the inlet of the pump.

3. The apparatus according to claim 2
wherein the grinder comprises a rotor and a stator,
wherein the rotor includes at least one blade, wherein the rotor is rotatable in operative connection with the impeller,
wherein the stator is in fixed operative connection with the housing, wherein the stator includes a plurality of fluid openings therethrough,
wherein the at least one blade is operative to move across the plurality of openings during rotation of the rotor.

4. The apparatus according to claim 2
wherein the first impeller vanes each comprise a curved helical first vane,
wherein each first vane includes a first forward face that extends from the first central area to the radially outward periphery of the first vanes,
wherein the first forward face comprises a leading face of the respective first vane when the impeller rotates in the pumping direction,
wherein an initial portion of the second fluid passage extends from the first peripheral area opening of the impeller cavity in a direction perpendicular to the first forward faces at the radially outer periphery of the first vanes.

5. The apparatus according to claim 3
wherein a termination portion of the second passage extends radially inward to the second central area.

6. The apparatus according to claim 4
wherein the second fluid passage includes an axially extending portion, wherein the axially extending portion extends parallel to the axis and fluidly between the initial portion and the termination portion of the second fluid passage.

7. The apparatus according to claim 4
wherein the second impeller vanes each comprise a curved helical second vane,
wherein each second vane includes a second forward face that extends from the second central area to the radially outward periphery of the second vanes, wherein the second forward face comprises a leading face of the respective second vane when the impeller rotates in the pumping direction,
wherein an initial portion of the third fluid passage extends from the second peripheral area opening of the impeller cavity in a direction perpendicular to the second forward faces of the second vanes at the radially outer periphery of the second vanes.

8. The apparatus according to claim 7
wherein the third fluid passage includes a radially outward extending portion,
wherein the radially outward extending portion of the third fluid passage extends fluidly intermediate of the initial portion of the third passage and the outlet.

9. The apparatus according to claim 8
wherein the impeller includes an axially centered projection, wherein the projection extends in the second axial direction from the base,
wherein the projection is bounded radially outwardly by a tapered side wall that extends further radially outward with increasing proximity to the base.

10. The apparatus according to claim 9
wherein each of the second vanes are bounded radially inwardly by a respective radially inward face, wherein the inward face of each second vane is disposed radially outward from the tapered side wall.

11. The apparatus according to claim 10
wherein the housing includes a cylindrical fluid chamber, wherein the cylindrical fluid chamber extends in the second axial direction relative to the axially centered projection,
wherein the termination portion of the second fluid passage terminates in a passage opening to the cylindrical fluid chamber.

12. The apparatus according to claim 11
wherein the pump is configured to operate in an operational condition with the axis extending vertically,
wherein in the operational condition of the pump the passage opening of the termination portion of the second fluid passage axially overlies the tapered side wall.

13. The apparatus according to claim 12
wherein the first impeller vanes and the second impeller vanes extend in pairs in opposed relation from the base.

14. The apparatus according to claim 13 wherein the impeller has a continuous material cross-section from a furthest axial side in the second axial direction of each second impeller vane of the pair, to a furthest axial side in the first axial direction of each respective first impeller vane of the respective pair, from a radially inward face of each first and second impeller vane continuously radially outward to a periphery of each respective first and second impeller vane of the respective pair.

15. The apparatus according to claim 1
wherein the first impeller vanes and the second impeller vanes extend in pairs in opposed relation from the base.

16. The apparatus according to claim 1
wherein the impeller includes an axially centered projection, wherein the projection extends in the second axial direction from the base,
wherein the projection is bounded radially outwardly by a tapered side wall that extends further radially outward with increasing proximity to the base.

17. The apparatus according to claim 16
wherein the pump is configured to operate in an operational condition with the axis extending vertically,
wherein the second fluid passage terminates in the second central area in an opening that axially overlies the tapered side wall.

18. The apparatus according to claim 1
wherein the first impeller vanes each comprise a curved helical first vane,
wherein each vane includes a first forward face that extends from the first central area to the radially outward periphery of the first vane,
wherein the first forward face comprises a leading face of the respective first vane when the impeller rotates in the pumping direction,
wherein an initial portion of the second fluid passage extends from the first peripheral area opening of the impeller cavity in a direction perpendicular to the first forward faces at the radially outer periphery of the first vanes.

19. The apparatus according to claim 1
wherein the second impeller vanes each comprise a curved helical second vane,
wherein each second vane includes a second forward face that extends from the second central area to the radially outward periphery of the second vane,
wherein the second forward face comprises a leading face of the respective second vane when the impeller rotates in the pumping direction, wherein an initial portion of the third fluid passage extends from the second peripheral area opening of the impeller cavity in a direction perpendicular to the second forward faces of the second vanes at the radially outer periphery of the second vanes.

20. Apparatus comprising:

a liquid pump including a housing, wherein the housing includes a liquid inlet and a liquid outlet, wherein the housing bounds an impeller cavity, an impeller configured to rotate about an axis in the impeller cavity, wherein the impeller includes a disc shaped base and a plurality of impeller vanes, wherein impeller vanes extend axially outward from the base on each of two axially opposed sides of the base, wherein the housing further includes a plurality of fluid passages, wherein a first fluid passage fluidly extends from the inlet to the impeller cavity in an area adjacent to the axis on a first side of the impeller, a second fluid passage fluidly extends from a first outlet opening on a periphery of the impeller cavity adjacent to a radially outer periphery of the vanes on a first side of the base, to a further area of the impeller cavity adjacent to the axis on a second side of the impeller, a third fluid passage fluidly extends from a second outlet opening on the periphery of the impeller cavity adjacent to the radially outer periphery of the vanes on the second side of the impeller, to the outlet.

21. The apparatus according to claim 20 and further comprising:

a grinder, where the grinder is positioned in the first fluid passage, wherein the grinder is in rotational connection with the impeller, wherein the grinder is operative to reduce size of solids suspended in liquid before the liquid reaches the impeller.

* * * * *